US009885983B2

(12) United States Patent
Prinsen

(10) Patent No.: US 9,885,983 B2
(45) Date of Patent: Feb. 6, 2018

(54) METHOD FOR HEAT TREATMENT OF MIXED MEDIA SHEETS

(71) Applicant: Océ Holding B.V., Venlo (NL)

(72) Inventor: Kevin H. J. R. Prinsen, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/432,615

(22) Filed: Feb. 14, 2017

(65) Prior Publication Data

US 2017/0248876 A1 Aug. 31, 2017

(30) Foreign Application Priority Data

Feb. 29, 2016 (EP) ..... 16157953

(51) Int. Cl.
*G03G 15/20* (2006.01)
*G03G 15/00* (2006.01)

(52) U.S. Cl.
CPC ..... *G03G 15/2003* (2013.01); *G03G 15/6594* (2013.01); *G03G 15/2007* (2013.01); *G03G 15/2039* (2013.01); *G03G 2215/1671* (2013.01)

(58) Field of Classification Search
CPC ..... G03G 15/2003; G03G 15/2007; G03G 15/2039; G03G 15/6594; G03G 2215/1671
See application file for complete search history.

(56) References Cited

U.S. PATENT DOCUMENTS 6,526,250 B1 * 2/2003 Usui ..... G03G 15/161 399/307
7,324,779 B2 1/2008 Anderson et al.
7,336,920 B2 2/2008 Anderson et al.
7,912,391 B2 * 3/2011 Kimura ..... B41J 2/325 219/216
7,936,920 B2 5/2011 James
8,164,803 B2 * 4/2012 Roof ..... G03G 21/08 345/641
8,478,152 B2 * 7/2013 Tomizawa ..... G03G 15/235 399/341
9,188,918 B1 11/2015 Ishii
(Continued)

FOREIGN PATENT DOCUMENTS

JP 2009-163064 A 7/2009

OTHER PUBLICATIONS

European Search Report EP 17 15 6650 dated Jun. 19, 2017; pp. 1-2.

*Primary Examiner* — David Bolduc
(74) *Attorney, Agent, or Firm* — Birch, Stewart, Kolasch & Birch, LLP

(57) ABSTRACT

A method for heat treatment of mixed media sheets in an image reproduction apparatus having an image forming station, a heat treatment station, a conveying path for conveying the sheets one by one through the image forming station and the heat treatment station, and a duplex loop for looping sheets back from the heat treatment station to the image forming station includes pre-heating a sheet before an image is formed thereon in the image forming station. The pre-heating includes the sub-steps of passing the sheet through the image forming station while the image forming station is idle, passing the sheet through the heat treatment station for pre-heating, and looping the sheet back to the image forming station.

6 Claims, 7 Drawing Sheets

(56) References Cited

U.S. PATENT DOCUMENTS

| | | | | |
|---|---|---|---|---|
| 2006/0067756 | A1* | 3/2006 | Anderson | G03G 15/2014 399/341 |
| 2006/0216091 | A1 | 9/2006 | Terashima | |
| 2006/0245801 | A1* | 11/2006 | Shibuya | G03G 15/1695 399/333 |
| 2006/0280535 | A1* | 12/2006 | Ueng | G03G 15/1695 399/390 |
| 2008/0174647 | A1* | 7/2008 | Kwong | B41J 11/002 347/102 |
| 2009/0116888 | A1* | 5/2009 | Kladias | G03G 15/1695 399/400 |
| 2010/0008683 | A1* | 1/2010 | Yoshikawa | G03G 15/1695 399/45 |
| 2011/0236093 | A1* | 9/2011 | Hurst | G03G 15/2007 399/336 |
| 2013/0051823 | A1* | 2/2013 | Harashima | G03G 15/0131 399/38 |

* cited by examiner

METHOD FOR HEAT TREATMENT OF MIXED MEDIA SHEETS

The invention relates to a method for heat treatment of mixed media sheets in an image reproduction apparatus having an image forming station, a heat treatment station, and a conveying path for conveying the sheets one by one through the image forming station and the heat treatment station, the apparatus further having a duplex loop for looping sheets back from the heat treatment station to the image forming station, the method comprising a step of pre-heating a sheet before an image is formed thereon in the image forming station.

US 2006216091 describes an image reproduction apparatus having a mechanism capable of performing printing on both sides of a sheet of paper by using a liquid toner as the developer.

JP2009163064 describes a double-sided printing machine and a double-sided printing method for a liquid-developing electrophotographic system by which a highly precise double-sided printing is performed.

In an image reproduction apparatus, a heat treatment of the image-receiving media sheets may be necessary for example in order to fuse the images that have been formed in the image forming station. The necessary duration of the heat treatment depends upon the heat capacity of the media sheets. Sheets with a higher heat capacity must be conveyed through the heat treatment station at a lower speed in order to raise the temperature of the sheets to a sufficient level.

A print job may require printing on mixed media sheets which have different heat capacities. For example, the print job may consist of printing a plurality of sets of copies on relatively thin media sheets, but each set may have a cover sheet which has a significantly larger thickness and, consequently, a higher heat capacity. In such cases, the printing speed and hence the productivity will be determined by the sheets with the highest heat capacity.

A higher productivity may be obtained when the image reproduction apparatus has an extra pre-heating station where the thicker media sheets may be pre-heated, so that they will reach the fuse station already with an elevated temperature.

U.S. Pat. Nos. 7,324,779 B2 and 7,336,920 B2 disclose image reproduction apparatus which have a plurality of fusing stations, so that the printed sheets may be subjected to a plurality of fusing steps for improving the permanence or appearance of the printed image.

However, an extra pre-heating station or an additional fuse station adds to the space requirements for the image reproduction apparatus and to the complexity and costs of the apparatus. Further operating the pre-heating station and the main heat treatment station simultaneously will temporarily increase the power consumption, which may be problematic when the power capacity of the grid is limited.

It is an object of the invention to provide a method tor heat treatment that permits to increase the productivity of an image reproduction apparatus without requiring additional equipment.

In order to achieve this object, the method according to the invention is characterized in that the step of pre-heating comprises the sub-steps of:

- passing the sheet through the image forming station while the image forming station is idle,
- passing the sheet through the heat treatment station for pre-heating, and
- looping the sheet back to the image forming station.

Thus, according to the invention, one and the same heat treatment station may be used for pre-heating the sheets and for the proper heat treatment. The sheets will be pre-heated when they are passed through the heat treatment station for a first time, and the proper heat treatment will be performed when the sheets are passed through the heat treatment station once again after an image has been formed. Consequently, a high conveying speed may be used even for the sheets with the higher heat capacity, so that a high productivity can be achieved.

In a typical scenario, only a relatively small fraction of the mixed media sheets to be processed will need pre-heating, so that extra time for passing sheets through the heat treatment station before an image is formed is required only for a small number of sheets, whereas the majority of the sheets which do not require pre-heating need to be passed through the heat treatment station only after an image has been formed. Consequently, the extra time for looping the sheets back will be outweighed by the increased conveying speed.

More specific optional features of the invention are indicated in the dependent claims.

In case of duplex printing, the normal sheets which do not need pre-heating will be passed through the image forming station and the heat treatment station twice, whereas the few thicker sheets will be passed through the image forming station and the heat treatment station at least three times.

A gap scheduling routine may be employed for controlling the feed of blank sheets to the image forming station at timings that lead to a highest possible productivity while assuring that the pre-heated sheets that are looped back from the heat treatment station will be appropriately inserted into gaps in the stream of blank sheets, with the desired output sequence of the sheets being preserved.

An embodiment example will now be described in conjunction with the drawings, wherein.

Figure 1:
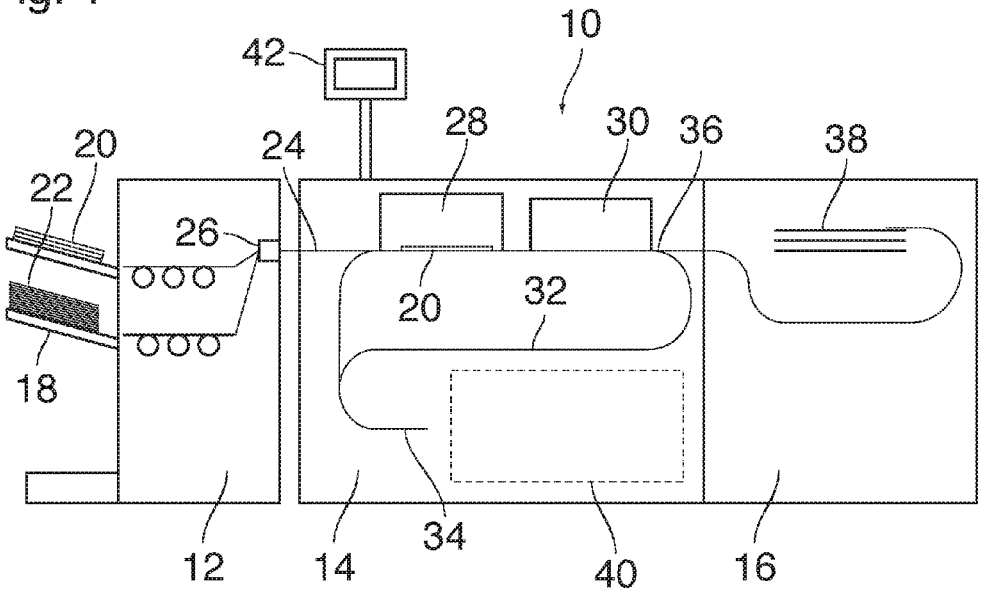
FIG. 1 is a view of an image reproduction apparatus to which the invention is applicable.

As is shown in FIG. 1, an image reproduction apparatus 10, e.g. an electrostatic printer, comprises an input section 12, a main body 14, and a finisher 16.

In the simple example shown here, the input section 12 has two input trays 18 accommodating stacks of media sheets 20, 22 of two different types. The sheets 20 in the upper tray have a relatively large thickness and are intended to form cover sheets for copy sets to be printed, whereas the sheets 22 are thinner and are intended to constitute all the other sheets of the sets of copies.

The input section 12 is arranged to withdraw the sheets 20, 22 from the trays 18 upon demand and to feed them one by one into a sheet conveying path 24 that extends from an exit 26 of the input section 12 through the main body 14 and to the finisher 16.

The main body 14 includes an image forming station 28 and a heat treatment station 30 which are arranged in that order along the sheet conveying path 24. The main body 14 further includes a duplex loop 32 that leads from the downstream side of the heat treatment station 30 back to the input side of the image forming station 28 and includes a sheet reversing mechanism 34 for reversing the orientation in which the sheets are fed back to the image forming station 28. A switch 36 is provided at the output side of the heat treatment station 30 for directing the sheets that leave the heat treatment station 30 either into the duplex loop 32 or into the finisher 16 where the sheets are stacked on an output tray 38 and optionally subjected to finishing operations such as stapling, punching or the like.

An electronic controller 40 is provided for controlling the operation of the image reproduction apparatus and communicates with a user interface 42.

The controller 40 analyses job specifications of a print job that has been submitted via the user interface 42, the job specifications determining among others for each of the printed copies, which of the two types of media sheets 20 and 22 is to be used. Based on this information, a gap scheduling routine that is implemented in the controller 40 determines a sequence in which the sheets 20, 22 are withdrawn from the trays 18 and fed through the apparatus.

In the condition shown in FIG. 1, one of the thicker sheets 20 has been fed into the image forming station 28. In this stage, however, the image forming station 28 is idle, so that no image is formed on the sheet 20.

Figure 2:
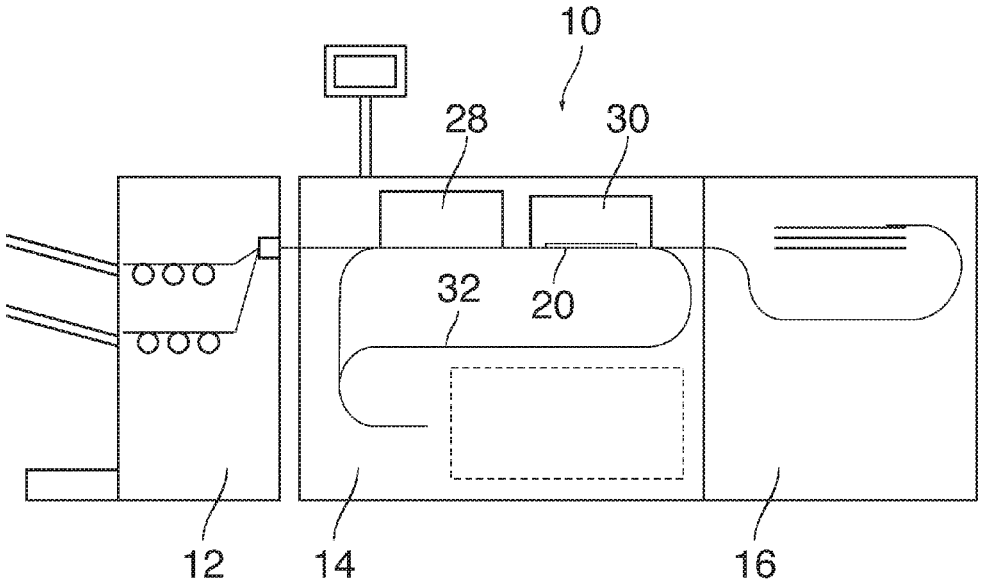
FIGS. 2 to 6 show the image reproduction apparatus in different stages in the execution of the method according to the invention.

As is shown in FIG. 2, the sheet 20 is then passed-on from the image forming station 28 to the heat treatment station 30 where a heat treatment is applied for pre-heating the sheet 20.

Figure 3:
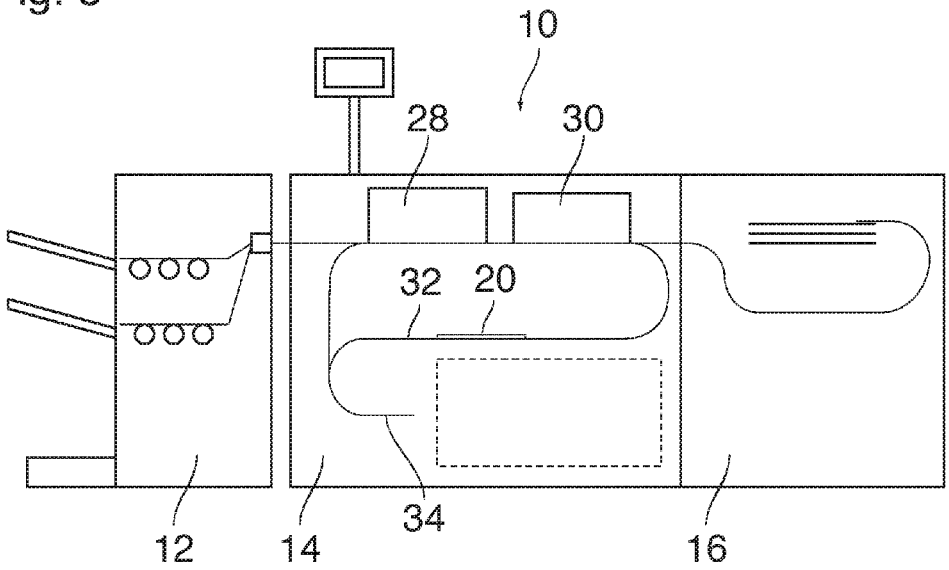

The pre-heated sheet 20 is then directed into the duplex loop 32, as has been shown in FIG. 3. There, the sheet reversing mechanism 34 will reverse the orientation of the sheet, and the sheet will be fed once again to the image forming section 28.

Figure 4:
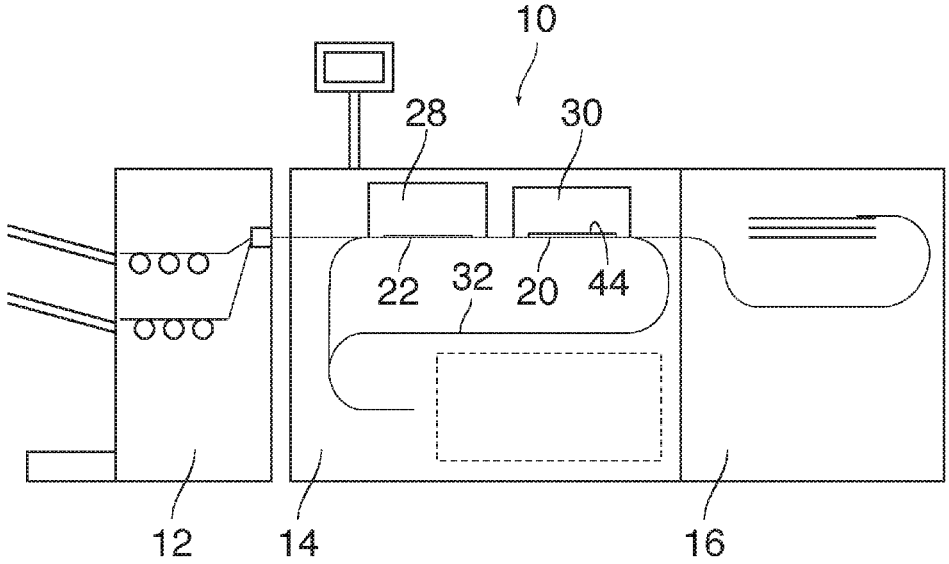

FIG. 4 shows a condition where an image 44 has been formed on the side of the sheet 20 which is now the top side, and the sheet has been conveyed once again to the heat treatment station 30 where, now, a heat treatment is applied for fusing the image 44 on the sheet. Meanwhile, one of the thinner sheets 22 has been fed into the image forming station 28 where an image will be formed on the top side of that sheet.

Figure 5:
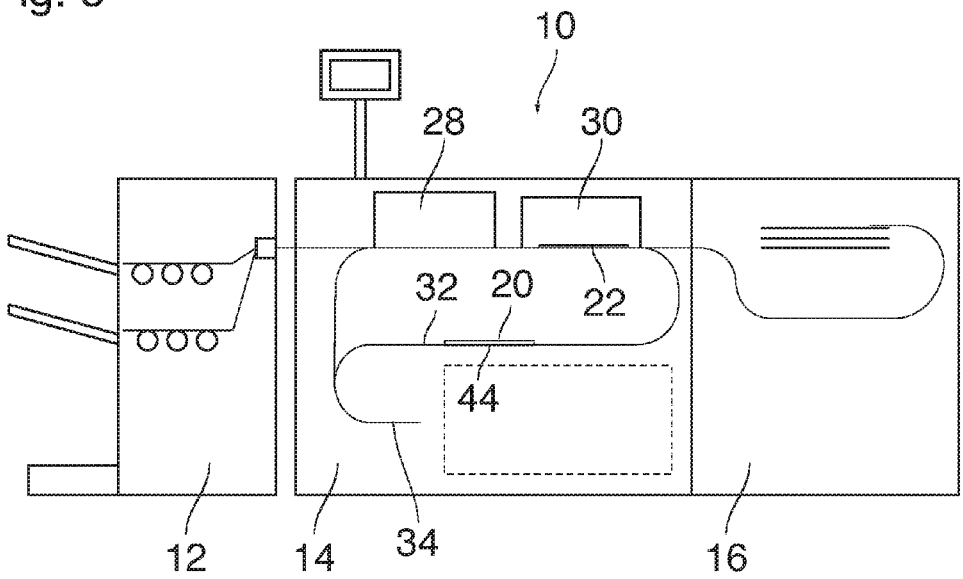

FIG. 5 shows the thinner sheet 22 with an image formed thereon in the heat treatment station 30 where the image is fused. The thicker sheet 20 has again been directed into the duplex loop 22 with the image 44 now facing downwards. The sheet reversing mechanism 34 will assure that the image 44 will still face downwards when the sheet 20 is once again returned to the image forming station 28.

Figure 6:
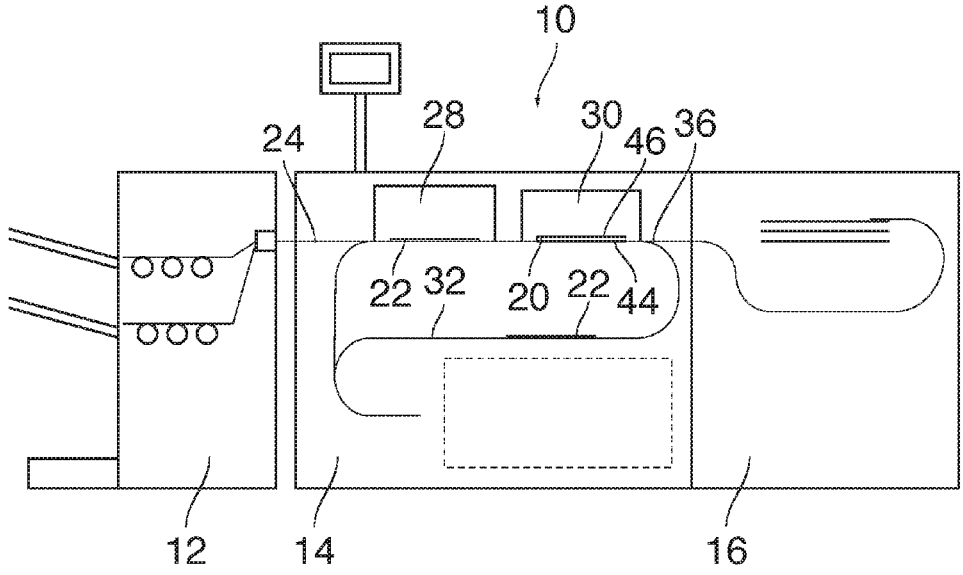

FIG. 6 shows a condition where another image 46 has been formed on the top side of the sheet 20 and the sheet passes through the heat treatment station 30 for a third time for fusing the image 46. Thereafter, the switch 36 is operated to direct the sheet 20, which now bears images 44, 46 on both sides, into the finisher 16. Meanwhile, another one of the thinner sheets 22 has been fed into the image forming station 28. This new sheet 22 will then receive an image on its top side and will be fused in the heat treatment section 30 and then directed into the duplex loop 32, whereas the other thin sheet 22 that is ready in the duplex loop will be returned to the image forming station 28 for forming an image on the second side.

In the process illustrated in FIGS. 1 to 6, a pre-heating treatment is applied only to the thick sheets 20 when they pass through the heat treatment station 30 for the first time, and these sheets will then pass through the heat treatment station 30 a second and a third time for fusing the images 44, 46. In contrast, the thinner sheets 22 which do not need pre-heating will pass through the heat treatment station 30 only twice, a first time when a first image has been formed and the second time when the second image has been formed on the second side of the sheet.

Of course, in case of simplex printing, the thick sheets will pass through the heat treatment station 30 twice whereas the thinner sheets pass through the heat treatment station 30 only once.

The supply of sheets into the sheet conveying path 24 is scheduled such that, whenever a sheet 20 or 22 returns from the duplex loop 32, it will be inserted in a gap in the stream of sheets that are supplied from the input section 12. Preferably, the supply of sheets should also be scheduled such that the printed sheets are output to the finisher 16 in the desired order, even though the numbers of times which these sheets pass through the heat treatment station 30 may differ from sheet to sheet.

An examples of a suitable gap scheduling routines will now be explained in conjunction with FIGS. 7 to 9.

Figure 7:
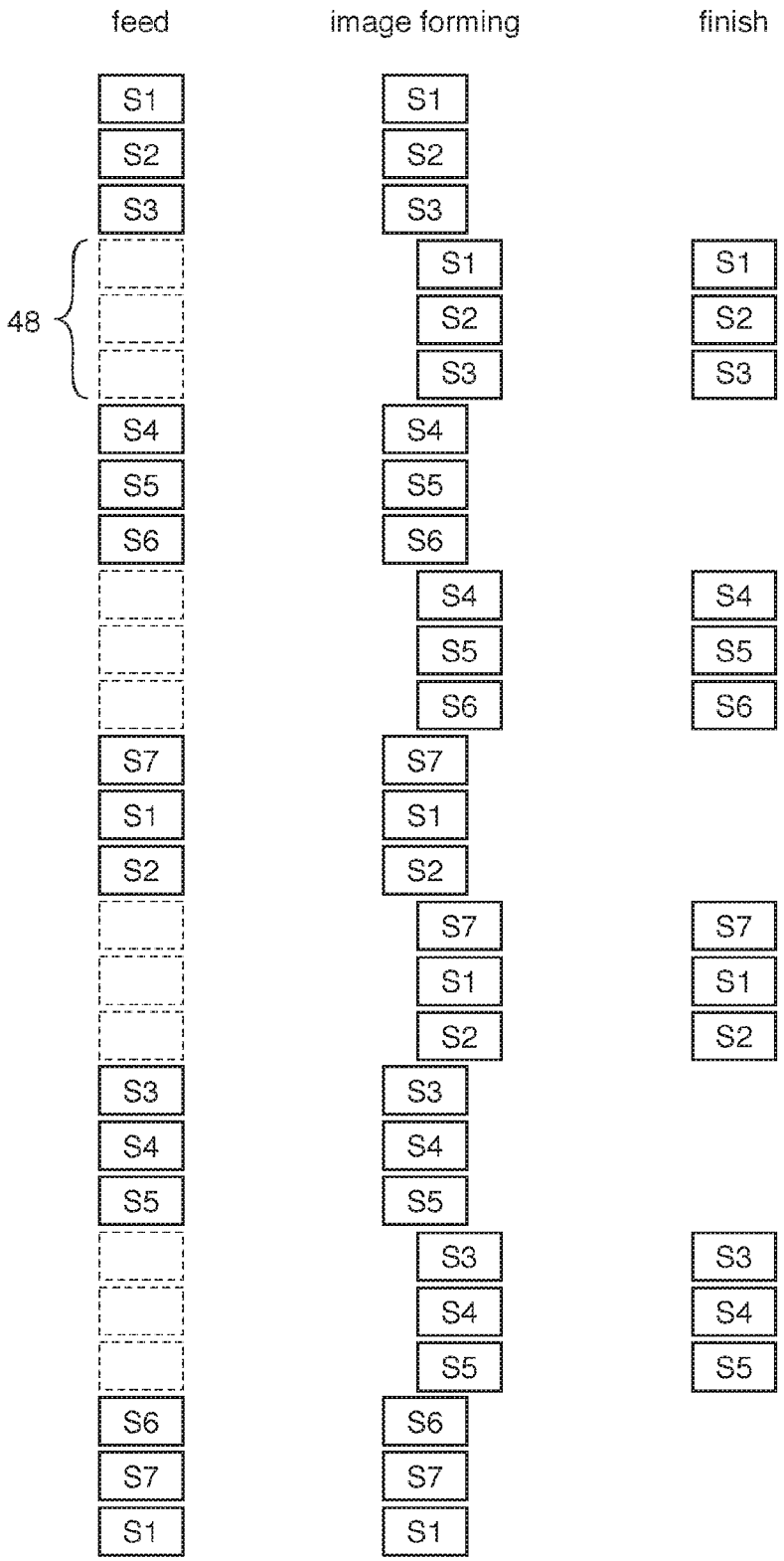
FIG. 7 is a diagram illustrating a conventional gap scheduling routine for duplex printing.

FIG. 7 illustrates a straightforward scheduling routine that may be applied when all the sheets have the same thickness and, consequently, none of the sheets requires pre-heating. It shall be assumed in this example that the print job is composed of sets of duplex sheets S1-S7, and each set comprises seven sheets. The left column "feed" in FIG. 7 illustrates the sequence in which the sheets S1-S7 for a first set and then the sheets S1-S7 for a second set are fed into the sheet conveying path 24 at the exit 26 of the input section 12. Rectangles shown in dashed lines in this column represent gaps 48 in the stream of sheets, each gap having a size of one or more sheets.

It shall further be assumed that the duplex loop 32 has a capacity of three sheets, so that it is possible to feed three sheets in immediate succession through the image forming station 28 and the heat treatment station 30 and then into the duplex loop 32 before the first of these sheets will arrive again at the image forming station 28. Consequently, a gap 48 with a size of three sheets has to be provided after each set of three sheets.

The second column "image forming" in FIG. 7 illustrates the sequence in which the sheets are processed in the image forming station 28. When the first image 44 has been formed and fused on each of the first three sheets S1-S3, these sheets are inserted into the gap 48 for forming the images 46 on the second side. The same applies to also subsequent batches of three sheets each.

The right column in FIG. 7 illustrates the sequence in which the printed duplex sheets are output to the finisher.

Now, another print job shall be considered wherein the first sheet S1 of each set of seven sheets shall be a cover sheet for which the media type should be that of the thicker sheets 20, whereas all the other sheets are sheets 22 of the thinner media type. In that case, the scheduling routine may be modified as shown in FIG. 8.

The stream of sheets and gaps in the conveying path 24 has been divided into feed cycles C1-C9 each of which comprises three time slots for feeding either one of the sheets or a gap with the size of one sheet.

In the first cycle C1, only the (thick) first sheet S1 is supplied in the first time slot, and the other two time slots are left empty. In the column "image forming", the rectangle that symbolizes the sheets S1 has been shown in dashed lines in order to indicate that the image forming station is idle and no image is formed on the sheet S1. The sheet will then be pre-heated in the heat treatment station 30. The first image on the sheet S1 is formed only when this sheet has returned from the duplex loop 32 for the first time.

Immediately thereafter, in the second cycle C2, the (thin) second sheet S2 is supplied, so that an image will be formed on the first side of that sheet. Although the duplex loop 32 could accommodate three sheets, the next time slot is left empty, so that only the two sheets S1 and S2 will be in the duplex loop.

The feed cycle C3 consists of a gap with a size of three sheets, and the sheets S1 and S2 are inserted into this gap for receiving the image 46 on the second side. Thereafter, these two sheets S1 and S2 will be output to the finisher.

In the next feed cycle C4, the next two (thin) sheets S3 and S4 will be supplied. The third time slot of that cycle is again left empty.

The next cycle C5 is again a three sheet gap into which the sheets S3 and S4 are inserted for receiving an image on the second side.

In the next cycle S6, the (thin) sheets S5 and S6 are fed for receiving an image 44 on the first side. In this case, however, a gap is left between the two sheets S5 and S6. The reason for this will become clear from the description that follows.

In the cycle C7, the sheets S5 and S6 are recirculated for receiving the image 46 on the second side, and the gap between them is filled by feeding the thick sheet S1 which will be the cover sheet of the next set. As in the first cycle C1, this sheet is passed through the idle image forming station 28.

Then, in the next cycle C8, the last (thin) sheet S7 of the present set is fed for receiving the first image 44 in the image forming station. Immediately thereafter, the sheet S1 returns from the duplex loop and also receives a first image 44 on the first side. The last time slot in this cycle is again left empty.

Then, in the cycle C9, the sheets S7 and S1 receive an image 46 on the second side and are output to the finisher.

Figure 8:
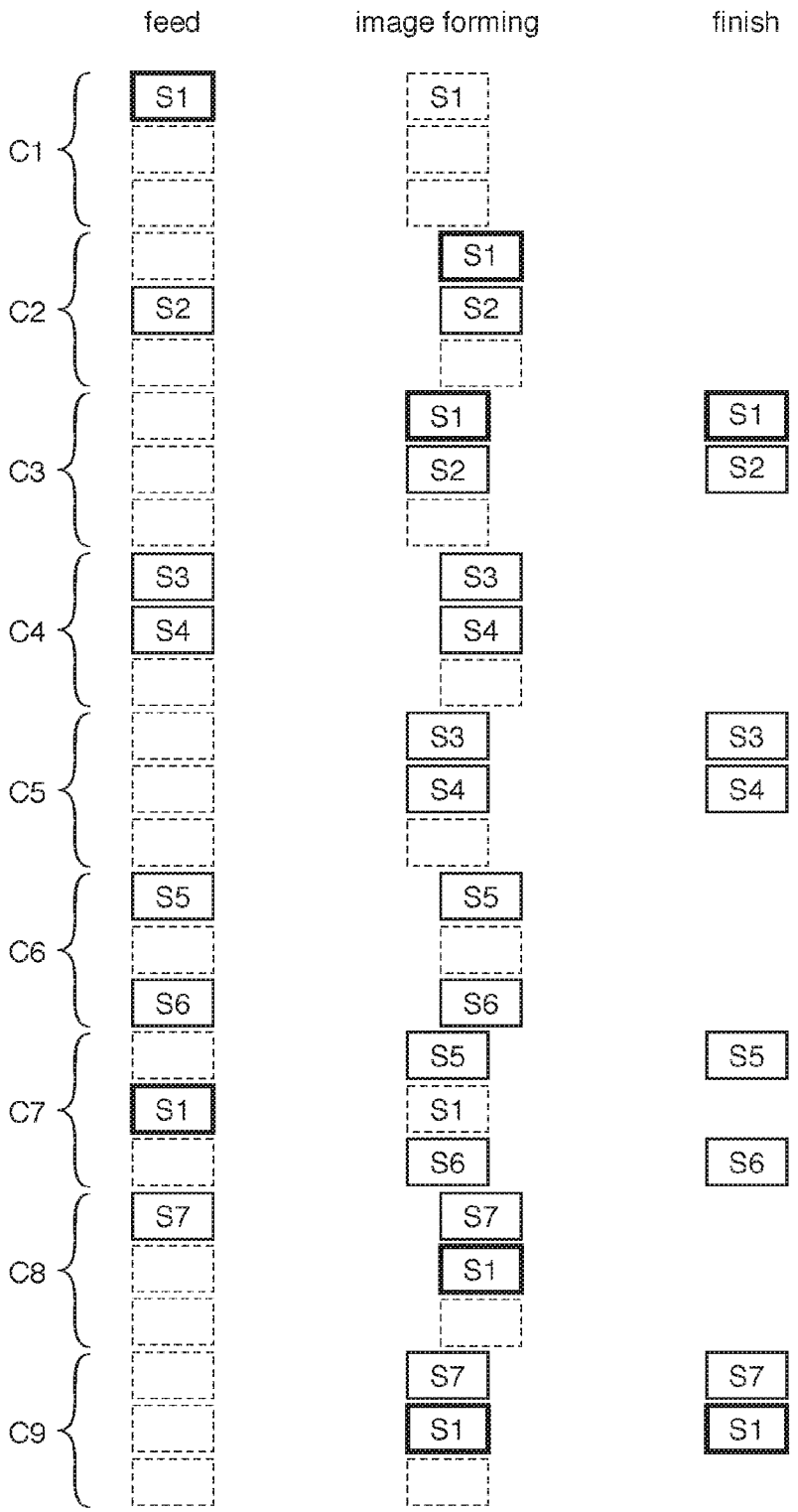
FIG. 8 is a diagram of a gap scheduling routine as modified in accordance with the invention.

As can be seen in the last column in FIG. 8, the sheets are output in the ordered sequence from S1 to S7, followed by the first sheet S1 of the next set. This has been achieved by supplying the sheet S1 for receiving the first image in the cycle C8 in the time slot immediately behind S7, i.e. in the second time slot of the cycle C8. A condition for this was that, in the preceding cycle C7, the sheet S1 has been passed through the idle image forming station 28 also in the second time slot, so that it will be returned to the image forming station in the cycle C8 just in time.

In turn, in order to be able to supply the sheet S1 in the cycle C7 in the second time slot, a gap had to be present in this time slot. This gap has been created in the cycle C6 by feeding the sheets S5 and S6 in the first and third time slot, thereby leaving a gap therebetween.

This principle may be applied repeatedly for printing the further sheets of the subsequent sets without disrupting the ordered sequence of sheets.

The necessary freedom for providing the gaps at the image forming station 28 at the right timings is obtained here by not fully exploiting the capacity of the duplex loop 32, i.e. by using only two of the three available time slots.

There may however be feed cycles in which it is possible to use the full capacity of the duplex loop and thereby to further enhance productivity. As an example, FIG. 9 shows a modified scheduling scheme which differs from that shown in FIG. 8 in that two sheets S2 and S3 are fed in the second cycle C2, so that, together with the sheet S1, the duplex loop is filled completely. In order to provide the gap for the sheet S1 in the correct position in the cycle C5, it is sufficient to leave a corresponding gap in the cycle C4.

On the other hand, there may be print jobs in which it is necessary to leave two or more slots empty in the duplex loop. This may for example be the case when the number of sheets per set (which was seven in FIGS. 8 and 9) is smaller than the capacity of the duplex loop 32 (which was three in FIGS. 8 and 9).

Figure 9:
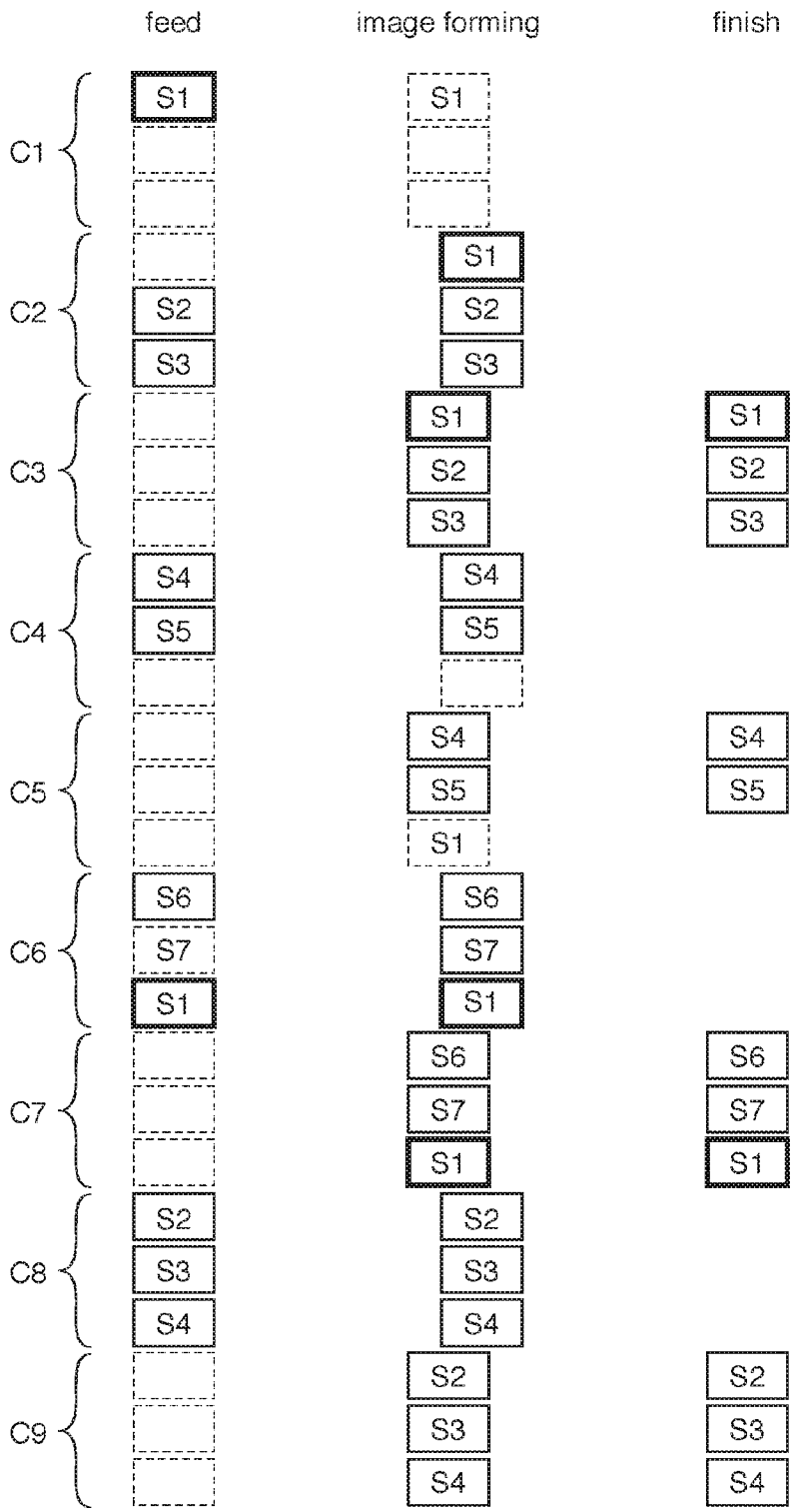
FIGS. 9 and 10 diagrams of gap scheduling routines according to other embodiments.

When comparing the first column "feed" in FIG. 9 to the first column in FIG. 7, it can be seen that even in the improved scheme according to FIG. 9, the number of empty slots or gaps is larger than in FIG. 7, which implies a certain loss in productivity. However, most jobs with mixed media sheets, this loss in production is more than compensated by the fact that pre-heating can be applied selectively to the thicker sheets, so that the conveying speed can be increased.

Moreover, in a realistic embodiment, the capacity of the duplex loop 32 will be significantly larger than three. It may for example be as large as eight or twenty or even more. In that case, the number of empty slots in relation to the number of filled slots will decrease significantly, so that the loss in productivity becomes smaller, especially when the job consists of a relatively large number of sets. Further, the productivity will of course be higher when the ratio of thin sheets to thick sheets in each set becomes larger.

When the heat capacity of the thick sheets is very large and/or the heating power of the heat treatment station 30 is small, the principle of the invention may also be generalized to the case that two or more pre-heating steps are performed for each of the thicker sheets before a first image is printed thereon.

When the number of pre-heating steps per sheet is odd, e.g. 1 or 3 , it will be observed that the pre-heated sheets pass through the sheet reverse mechanism 34 one or three times more than the sheets that are not pre-heated. Consequently when the thin sheets 22 receive the first image 44 on the top side, the thick sheets 20 will receive the first image 44 on the bottom side. This effect may be undesirable when the surface properties of the two sides of the sheets are not identical, e.g. when one side is coated and the other is not. In such a case, however, the effect may be compensated for by placing the sheets 20 in the bin 18 in reverse orientation, so that the sides receiving the first image 44 will face downwards for the sheets 20 whereas they face upwards for the sheets 22.

Figure 10:
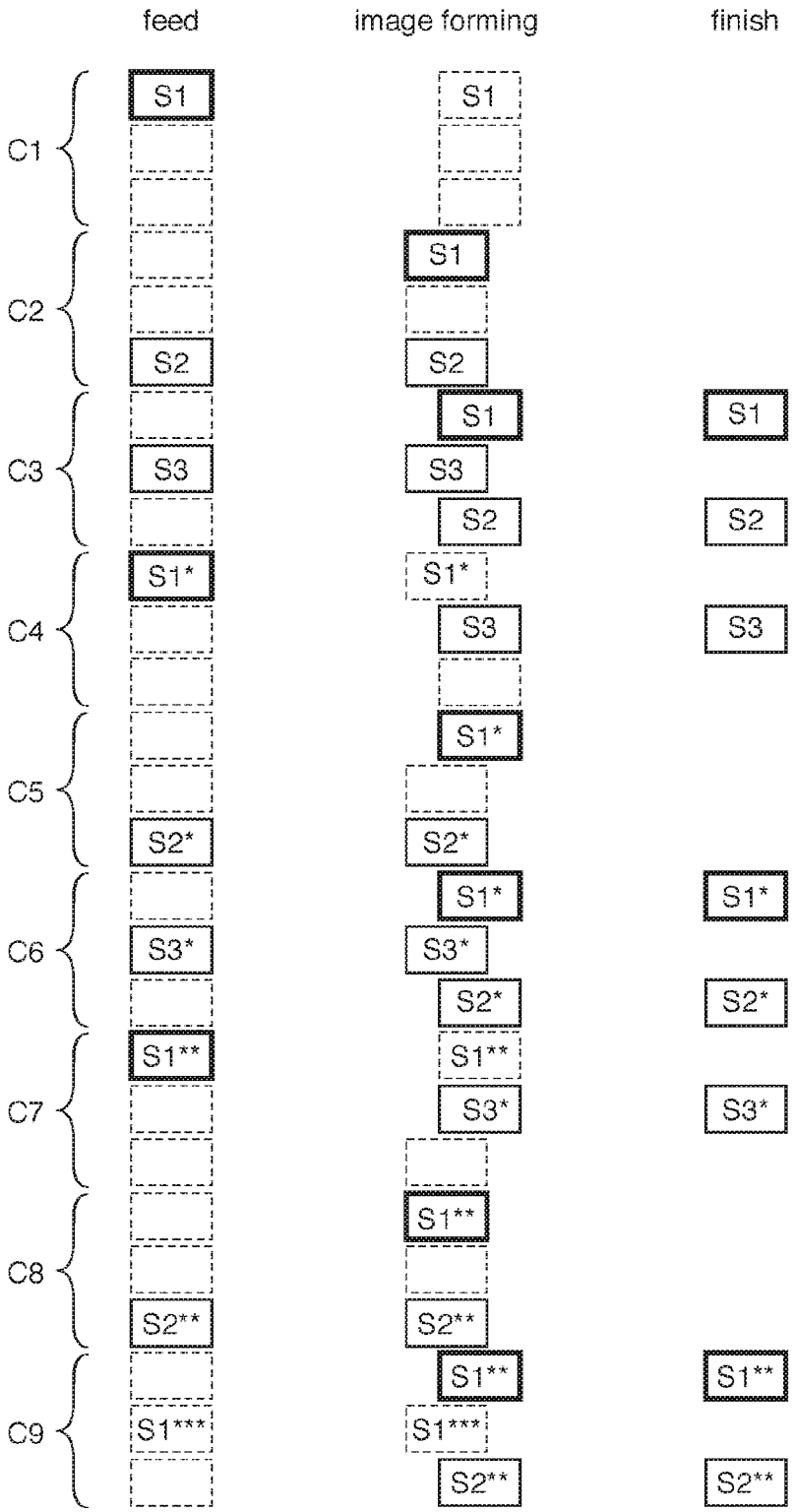

FIG. 10 shows yet another gap scheduling scheme which leads to a more regular output of the printed sheets. This is achieved by interleaving sheets that arrive at the image forming station for the first time with sheets that return from the duplex loop.

In the example shown in FIG. 10, it is assumed that each set consists of three duplex sheets. The sheets of the second set are marked with a star "*", the sheets of the third set with two stars "", and so on. It can be seen that printing the first side of the third sheet S3, S3***, etc of each set is interleaved with printing the second side of the first and second sheets which return from the duplex loop.

The invention claimed is:

1. A method for heat treatment of mixed media sheets having different heat capacities in an image reproduction apparatus, the image reproduction apparatus having an image forming station, a heat treatment station, a conveying path for conveying the sheets one by one through the image forming station and the heat treatment station, and a duplex loop for looping sheets back from the heat treatment station to the image forming station by means of a sheet reversing mechanism for reversing the orientation in which the sheets are fed back to the image forming station, the method comprising a step of pre-heating a sheet before an image is formed thereon in the image forming station, wherein the step of pre-heating comprises the sub-steps of:

passing the sheet through the image forming station while the image forming station is idle, so that no image is formed on the sheet;

passing the sheet through the heat treatment station for pre-heating; and looping the sheet back to the image forming station, and wherein a gap scheduling routine is applied for creating gaps in the stream of sheets to be supplied to the image forming station at suitable timings for receiving pre-heated sheets that return from the duplex loop in these gaps.

2. The method according to claim 1, for duplex printing, wherein each sheet to be pre-heated is passed through the image forming station and the heat treatment station three times, and each sheet that is not to be pre-heated is passed through the image forming station and the heat treatment station only twice.

3. The method according to claim 1, wherein the gap scheduling routine comprises leaving gaps such that the duplex loop is not always filled with sheets to its full capacity.

4. The method according to claim 1, wherein the gap scheduling routine comprises interleaving the printing of a first side of sheets that reach the image forming station for the first time with printing a second side of sheets that return from the duplex loop.

5. An image reproduction apparatus, comprising:

an image forming station;

a heat treatment station;

a conveying path for conveying the sheets one by one through the image forming station and the heat treatment station;

an electronic controller; and a duplex loop for looping sheets back from the heat treatment station to the image forming station by means of a sheet reversing mechanism for reversing the orientation in which the sheets are fed back to the image forming station, wherein the controller is configured to:

pre-heat a sheet before an image is formed thereon in the image forming station, and apply a gap scheduling routine to create gaps in the stream of sheets to be supplied to the image forming station at suitable timings for receiving pre-heated sheets that return from the duplex loop in these gaps, and wherein the pre-heating of the sheet comprises passing the sheet through the image forming station while the image forming station is idle, so that no image is formed on the sheet, passing the sheet through the heat treatment station for pre-heating, and looping the sheet back to the image forming station.

6. A software product comprising program code on a non-transitory machine-readable medium, the program code, when loaded into a programmable controller of an image reproduction apparatus, causing the controller to perform the method according to claim 1.

* * * * *